US007621467B1

(12) United States Patent
Garcia

(10) Patent No.: US 7,621,467 B1
(45) Date of Patent: Nov. 24, 2009

(54) ADJUSTABLE ARC IRRIGATION SPRAY NOZZLE CONFIGURED FOR ENHANCED SECTOR EDGE WATERING

(75) Inventor: Nathan T. Garcia, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 103 days.

(21) Appl. No.: 11/763,730

(22) Filed: Jun. 15, 2007

(51) Int. Cl.
*B05B 1/32* (2006.01)
*B05B 1/30* (2006.01)
*B05B 1/26* (2006.01)

(52) U.S. Cl. ..... 239/457; 239/200; 239/451; 239/DIG. 1

(58) Field of Classification Search ..... 239/200, 239/201, 203–206, 391, 396, 437–439, 451, 239/456, 457, 461, 505, 513–515, 518, 580, 239/DIG. 1
See application file for complete search history.

(56) References Cited

U.S. PATENT DOCUMENTS

| | | | | |
|---|---|---|---|---|
| 4,119,275 A | | 10/1978 | Hunter | 239/456 |
| 4,189,099 A | | 2/1980 | Bruninga | 239/200 |
| 4,220,283 A | | 9/1980 | Citron | 239/205 |
| 4,579,285 A | | 4/1986 | Hunter | 239/457 |
| 4,739,934 A | | 4/1988 | Gewelber | 239/246 |
| 5,205,491 A | | 4/1993 | Hadar | 239/457 |
| 5,322,223 A | | 6/1994 | Hadar | 239/457 |
| 5,642,861 A | | 7/1997 | Ogi et al. | 239/568 |
| 6,145,758 A | * | 11/2000 | Ogi et al. | 239/457 |
| 6,158,675 A | | 12/2000 | Ogi | 239/396 |
| 6,223,999 B1 | | 5/2001 | Lemelshtrich et al. | 239/391 |
| 6,957,782 B2 | | 10/2005 | Clark et al. | 239/200 |
| 2008/0169363 A1 | | 7/2008 | Walker | 239/457 |

* cited by examiner

*Primary Examiner*—Darren W Gorman
(74) *Attorney, Agent, or Firm*—Michael H. Jester

(57) ABSTRACT

An adjustable arc sprinkler includes first and second adjacent members that define a nozzle orifice. The first member can be connected to the end of a riser and defines a flow path leading to the nozzle orifice. The second member is rotatable relative to the first member to select a desired size of an adjustable arc fan-shaped water spray pattern when water travels through the flow path and is ejected from the nozzle orifice. A pair of features formed on the first and second members are configured to enhance a distribution of water at the edges of the water spray pattern.

10 Claims, 9 Drawing Sheets

ADJUSTABLE ARC IRRIGATION SPRAY NOZZLE CONFIGURED FOR ENHANCED SECTOR EDGE WATERING

FIELD OF THE INVENTION

The present invention relates to residential and commercial irrigation devices, and more particularly, to an improved spray head sprinkler.

BACKGROUND OF THE INVENTION

Many parts of the world have inadequate rainfall at different times of the year sufficient to sustain non-native vegetation, such as lawns, playing fields, golf course, flowers, shrubs and other ground cover. Irrigation systems have been extensively developed that include a plurality of sprinklers connected to pressurized water supply lines and solenoid actuated valves. An electronic controller automatically turns the valves ON and OFF in accordance with the run and cycle times of a watering program to provide vegetation in different zones of the sprinkler system with the desired amount of precipitation. A wide variety of sprinklers have been developed for use in such systems, including drip, bubbler, impact drive, spray, rotary stream, and rotor type sprinklers.

Spray type sprinklers are well known in the irrigation art and typically include a spray nozzle that is screwed to the upper end of a fixed vertical riser or a telescoping vertical riser in the case of a so-called pop-up sprinkler. The spray nozzle is usually a generally cylindrical construction made of plastic parts. Typically a fixed orifice distributes water radially in a relatively thin fan-shaped pattern to close-in vegetation, e.g. turf and shrubs located seventeen feet or less from the spray nozzle. The circumferential size of the fixed orifice is chosen to provide, for example, one-quarter, one-half and full circle arc of coverage. The size of the fixed orifice can also be selected to deliver a particular flow rate in terms of gallons per minute, although arc size largely determines flow rate. Usually the fixed orifice is sized and configured to provide matched rates of precipitation over a given sector size. For example, a one-quarter circle arc spray nozzle will typically deliver water at half the rate of a one-half circle arc spray nozzle of the same design.

Conventional spray nozzles often include a small throttling screw that can be turned with a screwdriver from the top side to adjust the flow rate of the sprinkler, which can also adjust the reach or radius to some degree. Examples of irrigation spray nozzles are disclosed in U.S. Pat. Nos. 4,189,099; 4,220,283; 4,739,934; 5,642,861; 6,158,675; and 6,957,782. Some spray type sprinklers include an internal pressure regulator as disclosed in U.S. Pat. No. 5,779,148 for example. Some spray type sprinklers include an internal debris strainer or screen as disclosed in U.S. Pat. No. 4,913,352.

U.S. Pat. No. 4,579,285 granted Apr. 1, 1986 to Edwin J. Hunter and entitled ADJUSTABLE SPRINKLER SYSTEM discloses an irrigation spray nozzle with an adjustable arc spray orifice that can be adjusted from about zero degrees to three hundred and sixty degrees. One of two opposing spiral peripheral lips can be rotated relative to the other by twisting a top screw to change the circumferential length of the nozzle orifice formed between the two lips. The height of the upper lip relative to the lower lip can also be adjusted with the same screw by holding the upper lip stationary and twisting the screw in order to change the vertical height of the nozzle orifice. Ed Hunter's '285 patented spray nozzle alleviated the necessity of manufacturing spray nozzles with different fixed spray patterns and it therefore has enjoyed, and continues to enjoy, widespread commercial success.

Hardscapes, such as concrete sidewalks, can absorb substantial solar energy and radiate heat to adjacent landscape, such as lawns watered with spray heads. Portions of the lawn immediately adjacent these hardscapes watered with conventional spray heads can to turn brown from inadequate watering even where the remainder of the lawn is watered sufficiently to keep it healthy and green.

SUMMARY OF THE INVENTION

In accordance with an embodiment of the present invention, an adjustable arc sprinkler includes first and second adjacent members that define a nozzle orifice. The first member can be connected to the end of a riser and defines a flow path leading to the nozzle orifice. The second member is rotatable relative to the first member to select a desired size of an adjustable arc fan-shaped water spray pattern when water travels through the flow path and is ejected from the nozzle orifice. A pair of features formed on the first and second members are configured to enhance a distribution of water at the edges of the water spray pattern.

DETAILED DESCRIPTION

Figure 1:
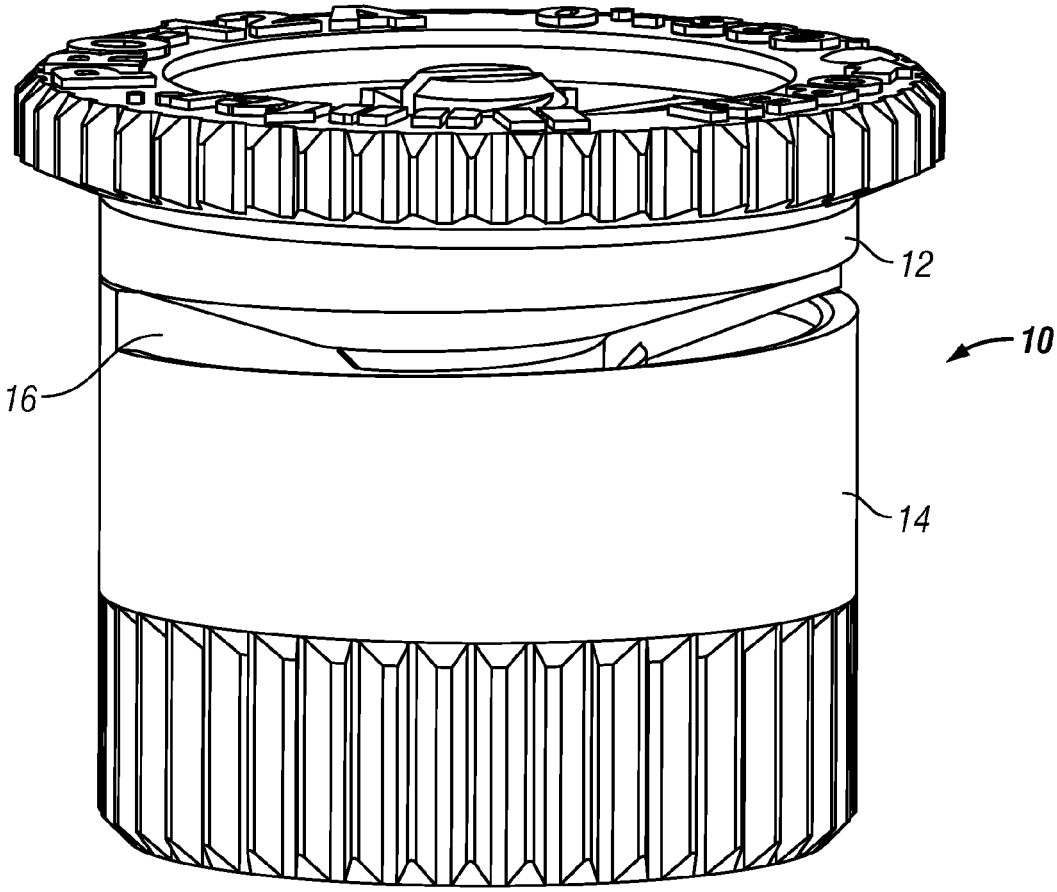
FIG. 1 is an enlarged side isometric view of an adjustable arc spray nozzle in accordance with an embodiment of the present invention.
Figure 5:
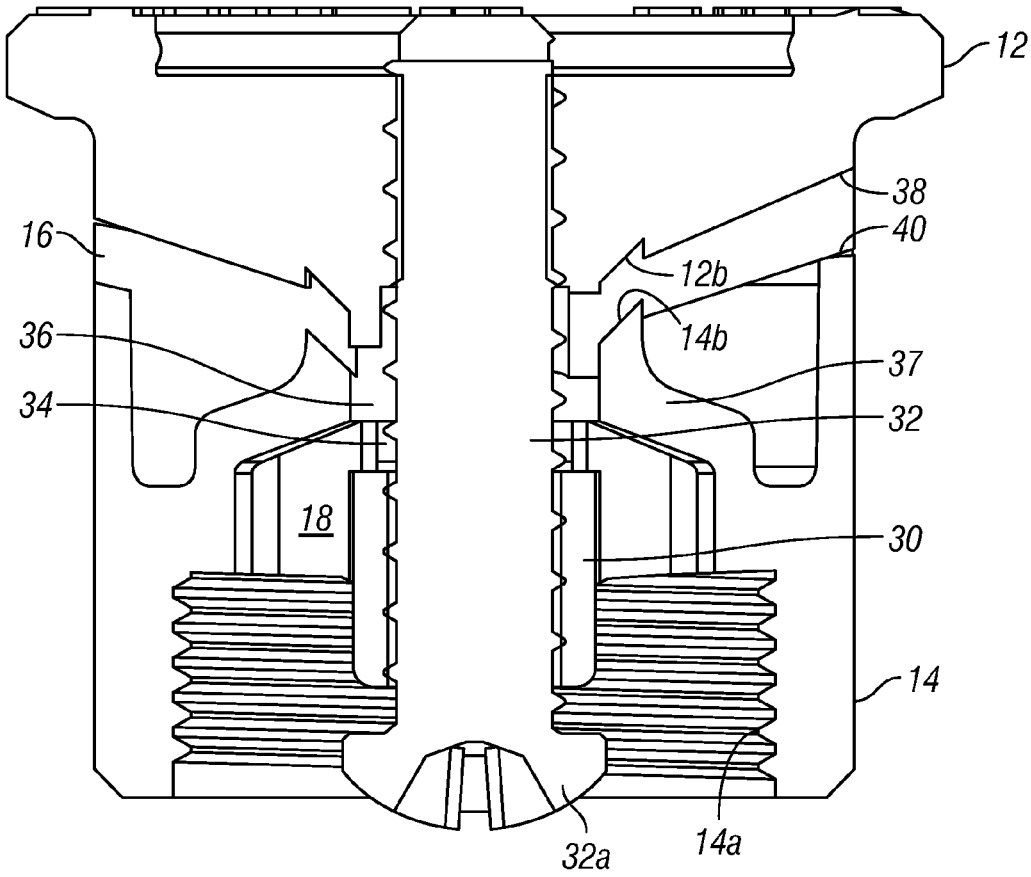
FIG. 5 is a vertical sectional view of the spray nozzle of FIG. 1.
Figure 9:
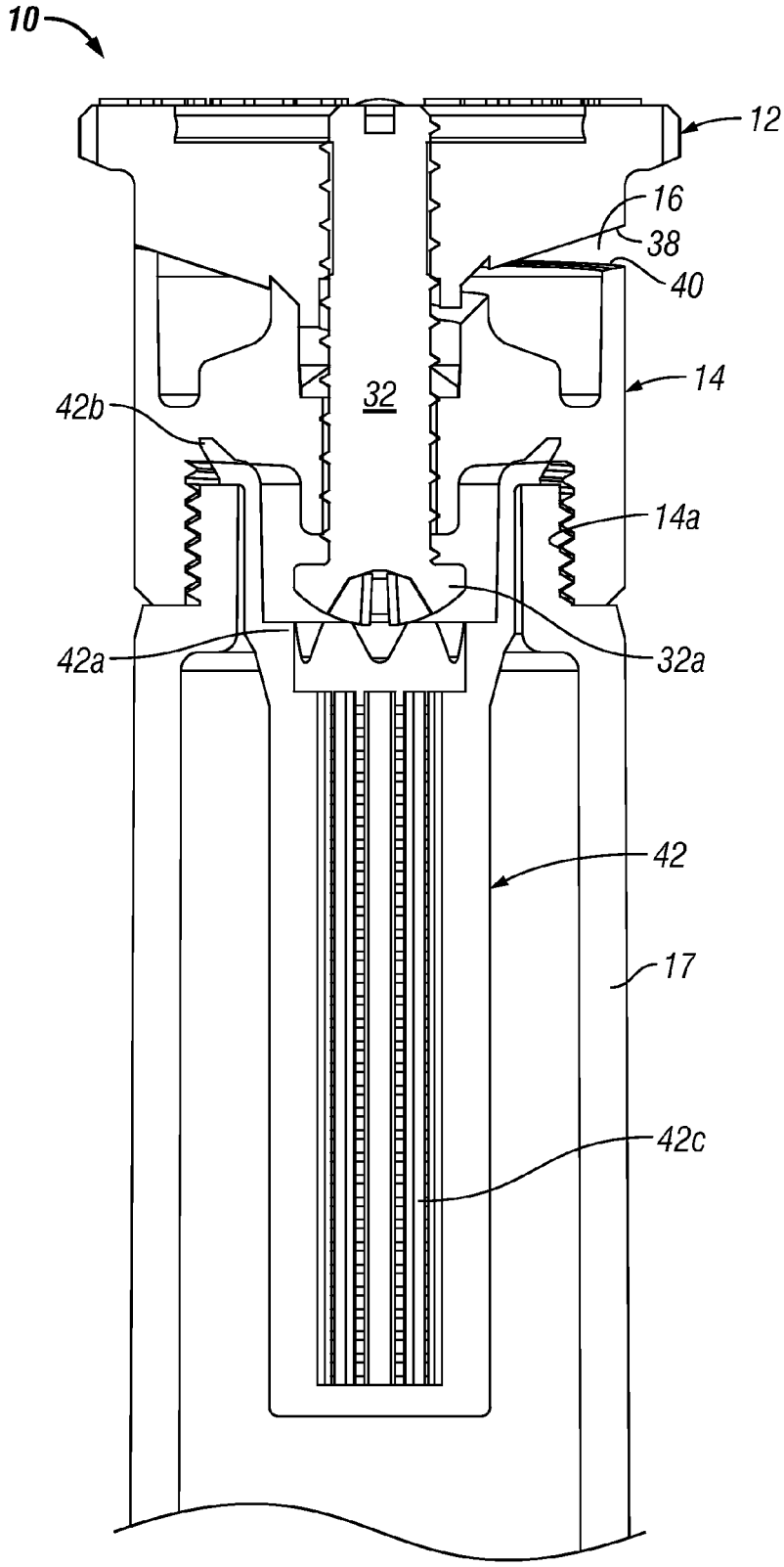
FIG. 9 is a vertical sectional view of the spray nozzle of FIG. 1 and a portion of a riser containing a screen, the spray nozzle being screwed over the riser.

Referring to FIGS. 1, 5 and 9, an adjustable arc spray type sprinkler 10 in accordance with an embodiment of the present invention is illustrated. Except for the water spray pattern enhancing features described hereafter, the sprinkler 10 is similar in overall construction and operation to the sprinkler disclosed in the aforementioned U.S. Pat. No. 5,479,285 granted Apr. 1, 1986 to Edwin J. Hunter, the entire disclosure of which is hereby incorporated by reference. The sprinkler 10 includes upper and lower adjacent cylindrical members 12 and 14. As hereafter described in detail, opposing surfaces of the cylindrical members 12 and 14 define a nozzle orifice 16. The lower member 14 has a female threaded segment 14*a* (FIG. 5) can be screwed over the male threaded upper end of a standard riser 17 (FIG. 9). The lower member 14 defines a flow path 18 (FIG. 5) leading to the nozzle orifice 16.

Figure 8:
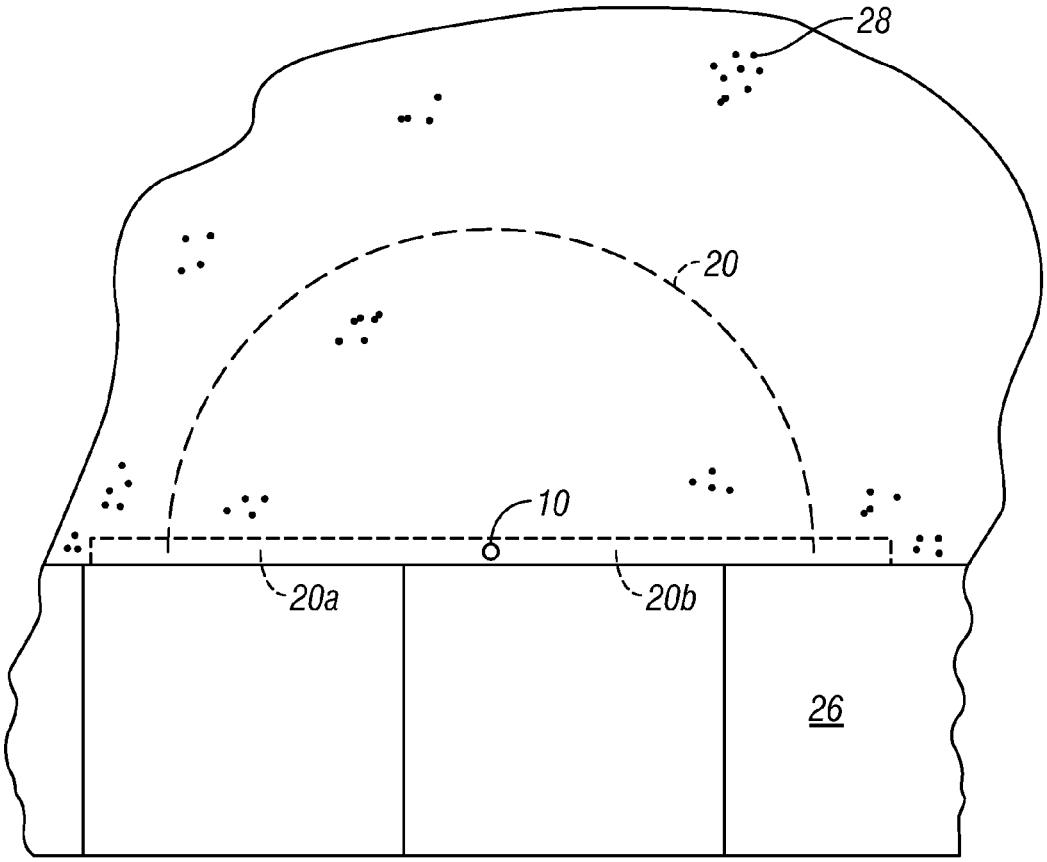
FIG. 8 is a diagrammatic illustration of a fan-shaped water spray pattern of the spray nozzle of FIG. 1.

The upper member 12 has a knurled segment 12*a* (FIG. 6) that facilitates gripping between the thumb and index finger. The upper member 12 and the lower member 14 have opposing inner helical peripheral lips 12*b* and 14*b* that partially define the nozzle orifice 16. The upper member 12 is rotatable relative to the lower member 14 to select the desired arc size of a fan-shaped water spray pattern 20 (FIG. 8) when water from the riser 17 travels through the flow path 18 and is ejected from the nozzle orifice 16. A pair of features, in the form of a swept cut 22 (FIG. 2) and a wall 24 (FIGS. 3 and 4), integrally formed on the upper and lower members 12 and 14, respectively, are configured to enhance a distribution of water at the edges of the water spray pattern 20 (FIG. 8). More specifically, in the example illustrated, the sprinkler 10 is positioned adjacent a concrete sidewalk 26 and is adjusted to produce a one hundred and eighty degree water spray pattern 20. Because of the swept cut 22 and the wall 24, the two edges of the water spray pattern have boundary zones 20*a* and 20*b* that receive additional water compared to the remainder of the spray pattern 20. This compensates for extra evaporation that occurs in the portion of the turf 28 located immediately adjacent to the hot sidewalk 26. In addition, or in the alternative, the boundary zones 20*a* and 20*b* of the water spray pattern 20 have increased radius, i.e. they extend radially a further distance than the remainder of the water spray pattern 20. This increased reach or radius at the sector edges can be advantageous in watering hard-to-reach areas of the turf 28. The edges of the semi-circular water spray pattern 20 are also sharper, i.e. better defined, than they would otherwise be without the swept cut 22 and wall 24, so less water ends up on the sidewalk 26.

Figure 6:
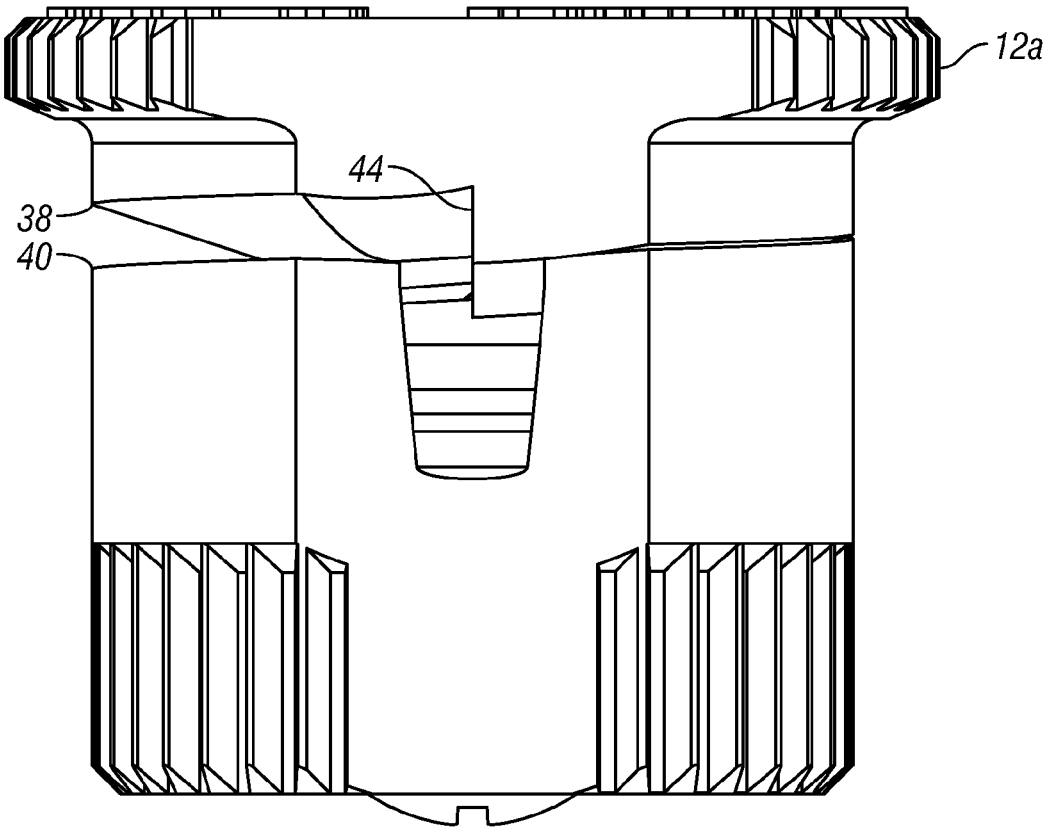
FIG. 6 is a side elevation view of the spray nozzle of FIG. 1 with portions broken away to reveal the swept cut feature on the lower side of the top member.

The lower member 14 includes a central sleeve 30 (FIG. 5) through which a stainless steel screw 32 is threaded. Apertures 34 (FIGS. 4 and 5) in the sleeve 30 allow water from passage 18 to flow through a central hole 36 in a nozzle forming member 37 of the lower member 14 and out the nozzle orifice 16. The inner helical lip 14*b* is defined by the upper end of the nozzle forming member 37. The upper member 12 is screwed over the threaded shank of the screw 32. The upper and lower members 12 and 14 have opposing peripheral helical edges 38 and 40 (FIG. 6). The upper peripheral helical edge 38 is formed on the underside of the upper member 12 The lower peripheral helical edge 40 is formed on the upper end of the nozzle forming member 37.

When the upper member 12 is manually rotated relative to the lower member 14 the circumferential extension of the nozzle orifice 16 is varied, as explained in detail in the aforementioned U.S. Pat. No. 5,479,285. This allows a user to select a desired size of the arc of the fan-shaped water spray pattern 20 (FIG. 8). An injection-molded debris screen 42 (FIG. 9) is inserted into the upper end of the riser 17 before that sprinkler 10 is screwed over the same. The tip of a small flat-headed screw driver (not illustrated) may be inserted in a slot in the upper end of the screw 32 to raise and lower the head 32*a* of the screw 32 relative to a shoulder 42*a* of the screen 42 to constrict flow and thereby adjust the radius of the sprinkler 10. The screen 42 has a generally cylindrical configuration with a flared upper end 42*b* that rests on the upper end of the riser 17 and a lower perforated tubular portion 42*c* that filters sediment, grit and other debris to prevent it from clogging the nozzle orifice 16.

Figure 2:
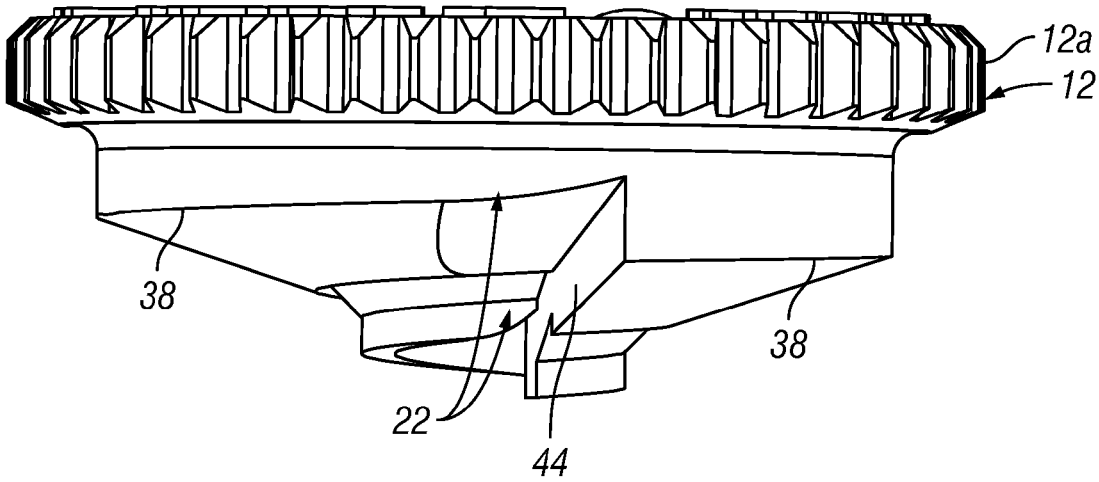
FIG. 2 is a side isometric view illustrating the swept cut feature on the lower side of the top member of the spray nozzle of FIG. 1.
Figure 3:
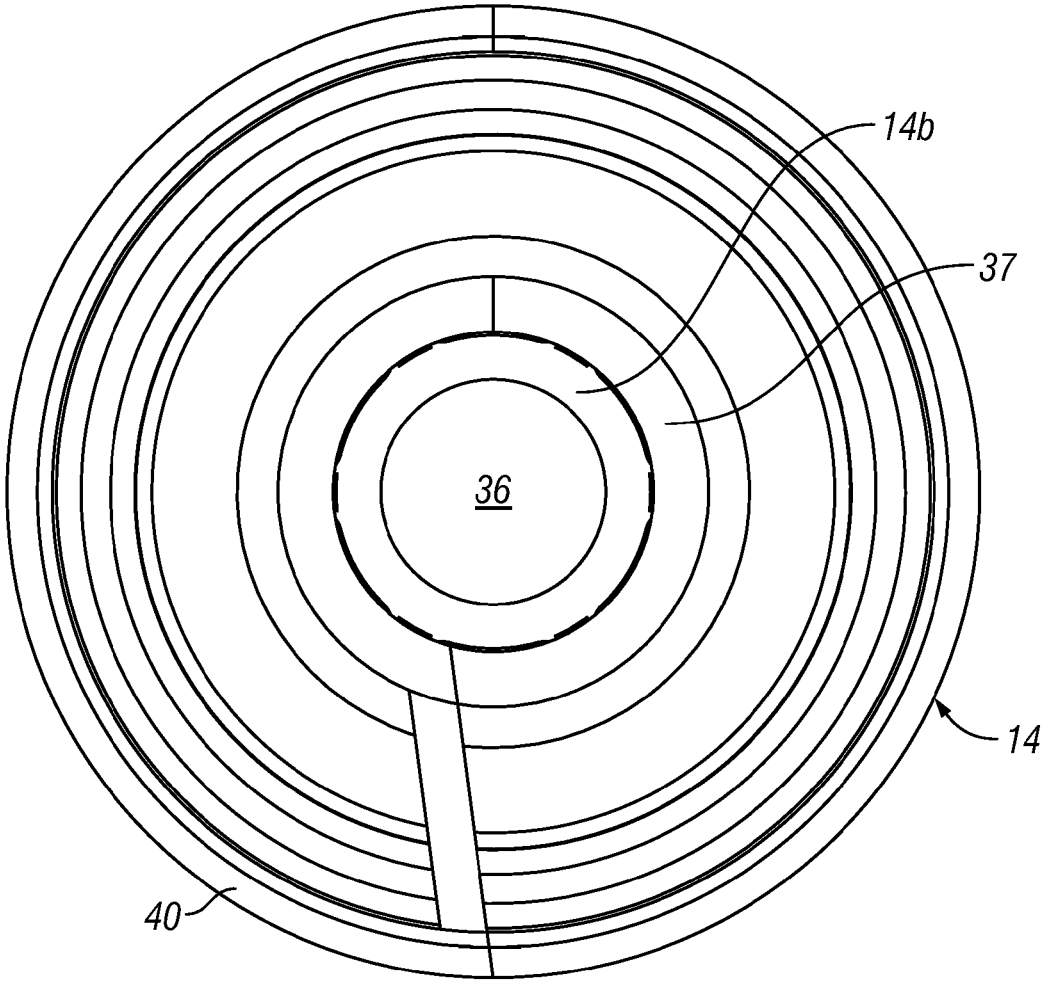
FIG. 3 is a top plan view of upper side of the bottom member of the spray nozzle of FIG. 1 illustrating the wall feature thereof.
Figure 4:
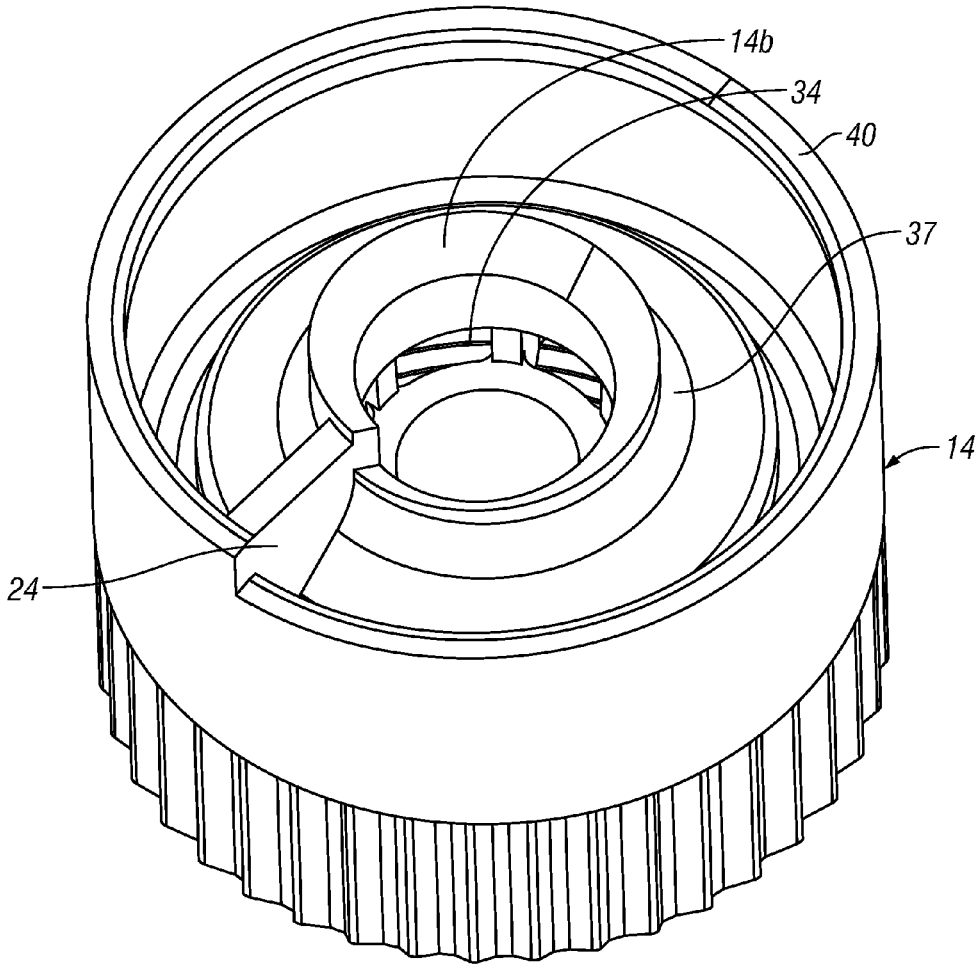
FIG. 4 is an isometric view of the bottom member of the spray nozzle of FIG. 1 illustrating the wall feature thereof.
Figure 7:
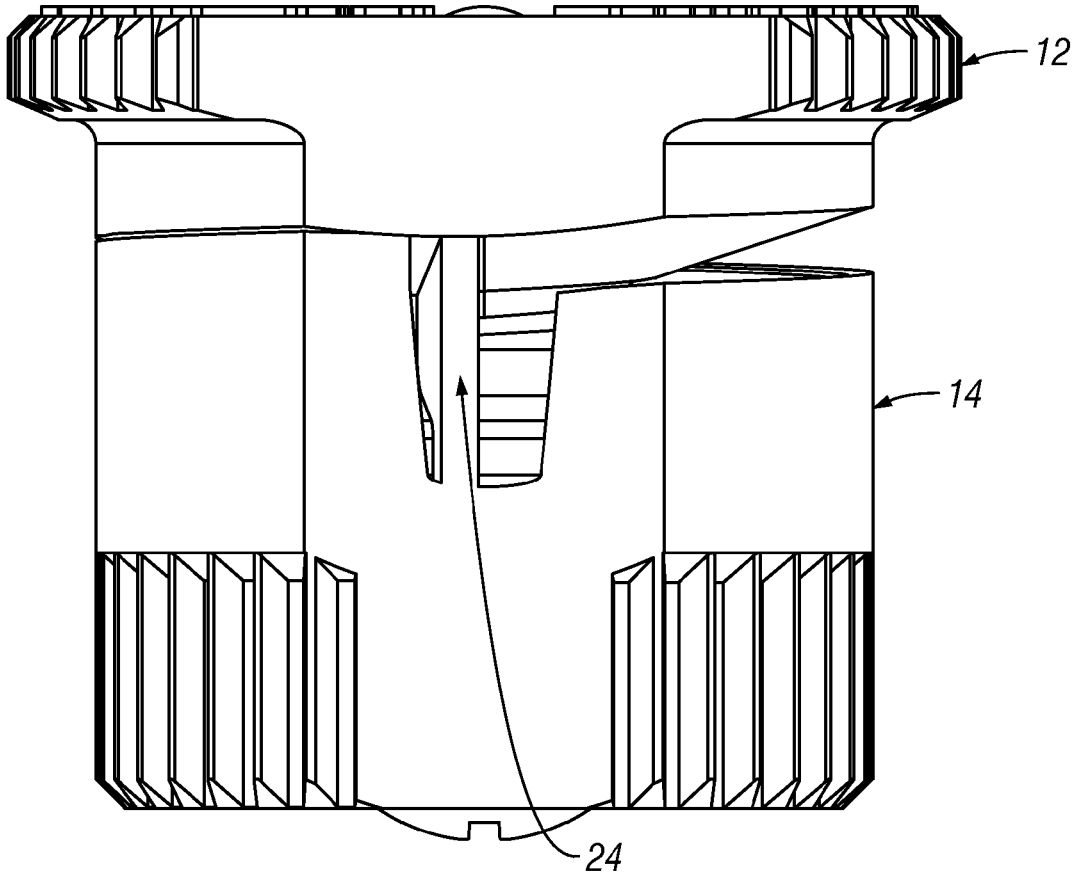
FIG. 7 is a side elevation view of the spray nozzle of FIG. 1 with portions broken away to reveal the wall feature on the upper side of the bottom member.

Referring to FIG. 2, the swept cut 22 on the underside of the upper member 12 preferably takes the form of an upward taper that accentuates the helical shape of the upper helical edge 38 in the final highest segment of the helical edge 38. The swept cut 22 is the leading edge feature and is located adjacent a vertical shoulder 44 that connects the terminal ends of the upper peripheral helical edge 38. Referring to FIGS. 3, 4 and 7, the wall 24 is a thin vertical extension formed on the lower member 14 that connects the terminal ends of the lower peripheral helical edge 40. The wall 24 forms the trailing edge feature and preferably extends in a tangential direction relative to a central axis of the sprinkler 10. In the embodiment illustrated, the wall 24 is located approximately seven and one-half degrees off center to pull additional water to the sector edge.

While I have described an embodiment of an adjustable arc irrigation spray nozzle configured for enhanced sector edge watering, it will be apparent to those skilled in the art that my invention can be modified in both arrangement and detail. Therefore, the protection afforded my invention should only be limited in accordance with the scope of the following claims.

I claim:

1. A sprinkler, comprising:

upper and lower generally cylindrical members having opposing peripheral helical edges defining a nozzle orifice, the upper member being rotatable relative to the lower member to select a desired arc size of a fan-shaped water spray pattern ejected from the nozzle orifice, the upper member having a swept cut that forms an upward taper of a final highest segment of the peripheral helical edge of the upper member, and the lower member having a vertically extending wall that connects a pair of terminal ends of the lower peripheral helical edge, the swept cut and the wall being configured to increase the amount of water received at a pair of edges of the fan-shaped water spray pattern.

2. The sprinkler of claim 1 wherein the first and second members are connected by a screw.

3. The sprinkler of claim 1 wherein the wall extends tangentially relative to a central axis of the sprinkler.

4. The sprinkler of claim 2 wherein the lower member includes a central sleeve through which the screw is threaded.

5. The sprinkler of claim 1 wherein the lower member has a threaded segment configured to screw to a riser.

6. The sprinkler of claim 1 wherein the swept cut and the wall are configured to increase a range of water otherwise distributed at the edges of the fan-shaped water spray pattern.

7. The sprinkler of claim 1 wherein the upper and lower generally cylindrical members have opposing inner helical peripheral lips.

8. The sprinkler of claim 7 wherein the swept cut extends radially between the peripheral helical edge and the inner helical peripheral lip on the underside of the upper member.

9. The sprinkler of claim 7 wherein the wall extends radially to the inner helical peripheral lip of the lower member.

10. The sprinkler of claim 1 wherein the swept cut is located adjacent a vertical shoulder that connects the terminal ends of the peripheral helical edge of the upper member.

* * * * *